United States Patent [19]

Campbell

[11] 4,142,256

[45] Mar. 6, 1979

[54] SAFETY SPOUT FOR COMBINATION TOILET AND LAVATORY

[75] Inventor: J. Les Campbell, Burlingame, Calif.

[73] Assignee: Aluminum Plumbing Fixture Corp., Burlingame, Calif.

[21] Appl. No.: 916,103

[22] Filed: Jun. 16, 1978

[51] Int. Cl.[2] ..... E03D 11/03; E03D 11/13

[52] U.S. Cl. ..... 4/3; 4/166; 4/167; 4/168; 4/169; 4/DIG. 2

[58] Field of Search ..... 4/3, 2, 312, 7, 6, 166, 4/168, 167, 169, DIG. 2

[56] References Cited

U.S. PATENT DOCUMENTS

| | | | |
|---|---|---|---|
| 526,240 | 9/1894 | Leyare | 4/168 X |
| 2,184,722 | 12/1939 | McLaughlin | 4/169 |
| 2,495,201 | 1/1950 | Snowball | 4/3 |
| 2,552,546 | 5/1951 | Fergusson | 4/3 |
| 2,907,048 | 10/1959 | Gould | 4/2 |
| 3,887,947 | 6/1975 | Tosca | 4/2 |
| 4,089,073 | 5/1978 | Campbell | 4/3 |

*Primary Examiner*—Henry K. Artis
*Attorney, Agent, or Firm*—Robert G. Slick

[57] ABSTRACT

In a combination toilet fixture having a fixed toilet bowl and a swing-out lavatory, a swivel device is provided on the spout so that the spout automatically swings out of the way when the toilet is in use, preventing possible injury to the user.

2 Claims, 4 Drawing Figures

SAFETY SPOUT FOR COMBINATION TOILET AND LAVATORY

SUMMARY OF THE INVENTION

Combination plumbing fixtures are frequently used in nursing homes, hospitals, and the like. The combination fixture has a fixed toilet bowl with a swinging lavatory which swings over the toilet when it is desired to use the lavatory.

Such fixtures are very efficient since they occupy much less space than an individual lavatory and toilet.

Further, they are esthetically pleasing since the ordinarily unattractive toilet bowl is concealed except when it is in actual use. Thus, the fixture can be installed along one wall of an ordinary hospital or nursing home room so that it is not necessary to provide a separate bathroom.

One difficulty with such fixtures is that the spout for the washbasin must extend out over the washbasin when the washbasin is in use and, when the washbasin is swung away to permit use of the toilet, the spout extends over the toilet.

It is undesirable to have the spout over the toilet for the reason that upon arising, the patient can easily strike his head on the spout which can result in severe injury. The problem is particularly aggravated by the fact that such fixtures are frequently used by elderly patients who are less adept at avoiding hazards than ordinary people.

In accordance with the present invention, a safety spout is provided wherein the spout automatically swings out of the way when the washbasin is swung to the inoperative position revealing the toilet.

Thus, when the toilet is in use, the spout is swung out of the way, obviating any possibility of contact between the spout and the patient's head.

The objects of the present invention are achieved in a very simple and economical manner which adds little to the expense of the fixture and does not detract from the utility of the fixture in any manner.

Various other features and objects of the invention will be brought out in the balance of the specifications.

DESCRIPTION OF THE PREFERRED EMBODIMENTS

Figure 1:
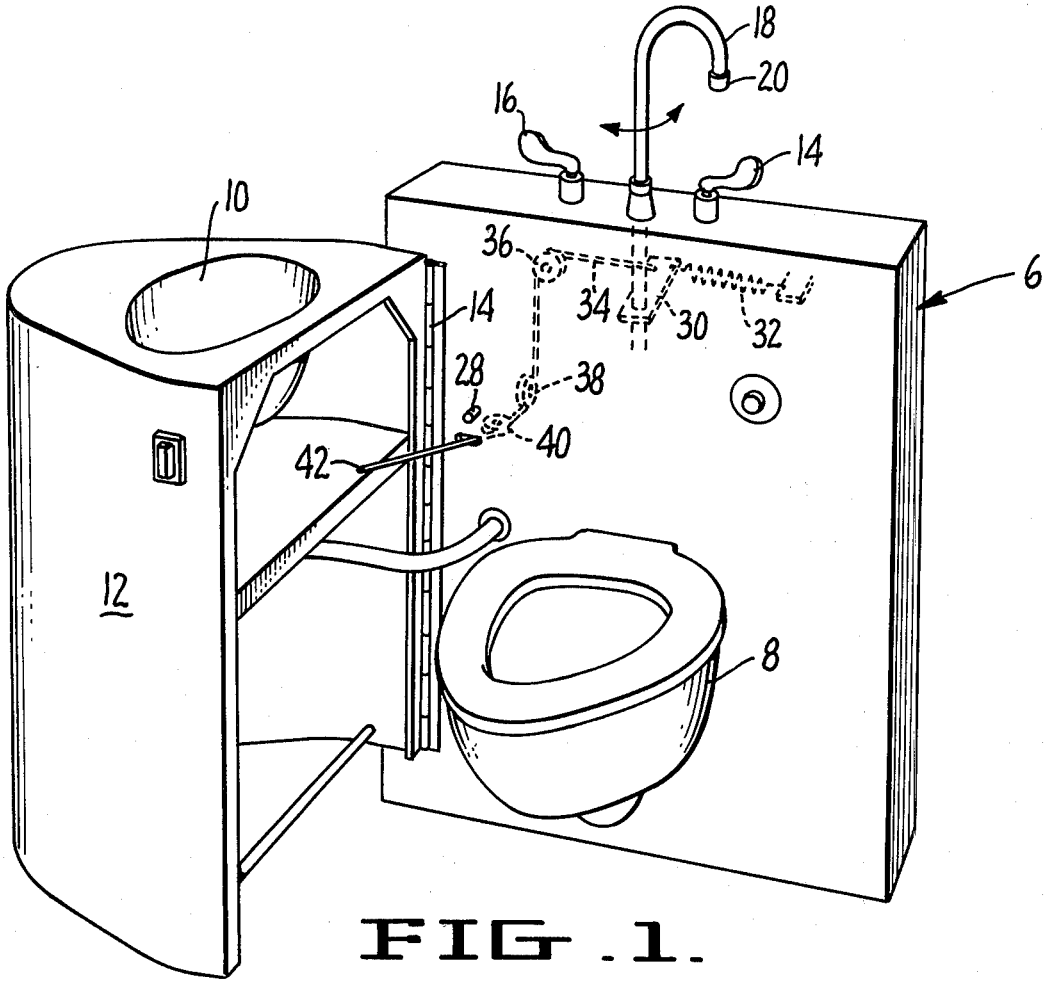
FIG. 1 is a perspective view of a combination plumbing fixture embodying the present invention showing the lavatory swung out of the way so that the toilet can be used.
Figure 2:
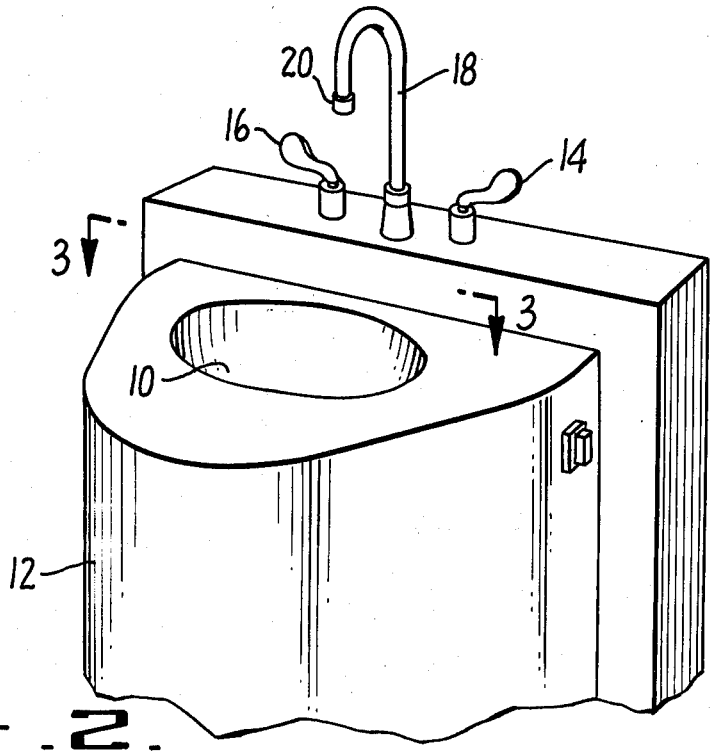
FIG. 2 is a partial perspective view of the fixture showing the position of the parts when the lavatory can be used.

Referring now to the drawings by reference characters, there is shown a combination fixture which includes a cabinet 6, suitable for mounting on a wall which has a toilet bowl 8 attached thereto. A lavatory bowl 10 is mounted in the frame 12 which is mounted on hinges 14 so that it can be swung outward to a position as is shown in FIG. 1, wherein the toilet 8 can be used or to a position against the cabinet, as is shown in FIG. 2, in which position the lavatory bowl 10 can be used.

Also mounted on the cabinet are the usual valve handles 14 and 16 for controlling the flow of water to a spout 18. Spout 18 is of the gooseneck variety and has a terminal end 20 which normally extends out over the lavatory bowl 10, as is shown in FIG. 2, so that one can use the lavatory in the usual manner with water discharged from the spout 18 flowing into the bowl 10.

It is apparent that if the spout 18 has terminal end 20 extending over the toilet bowl when the lavatory is swung outward, that a patient rising from toilet 8 might hit his head on the end 20 of the spout.

Figure 3:
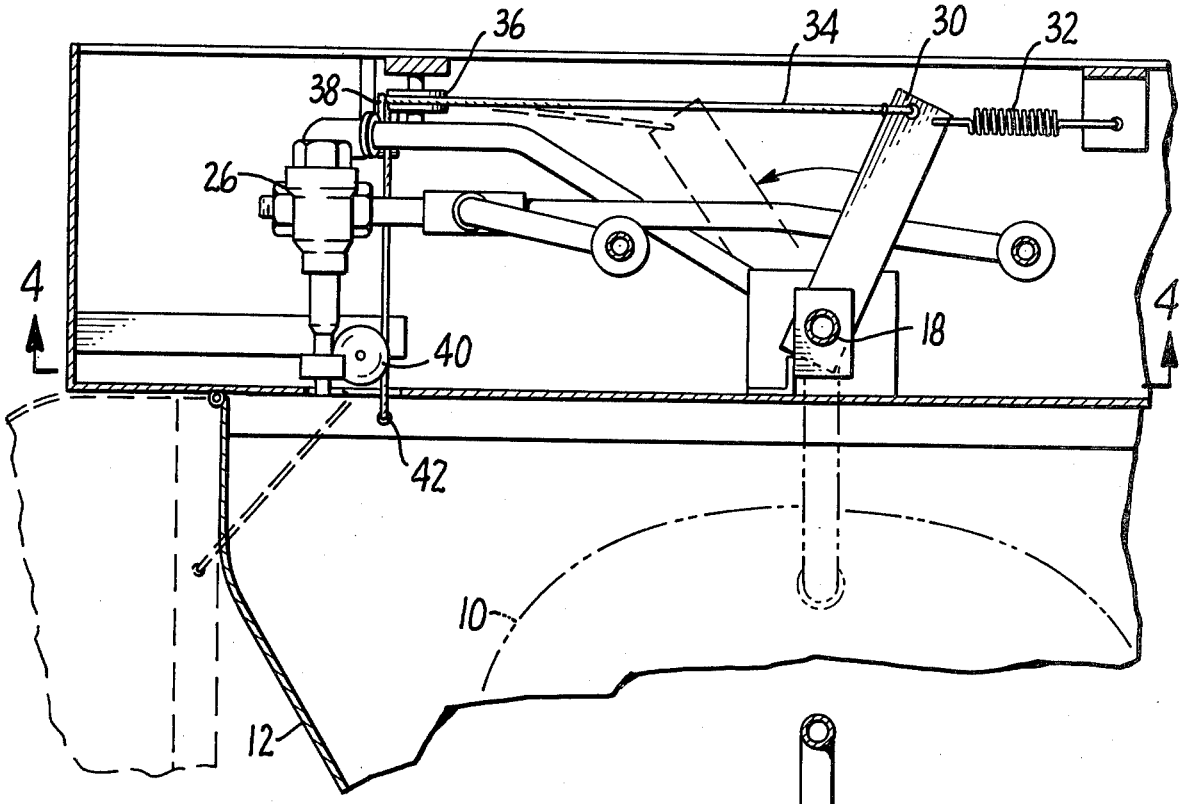
FIG. 3 is a section on the line 3—3 of FIG. 2.
Figure 4:
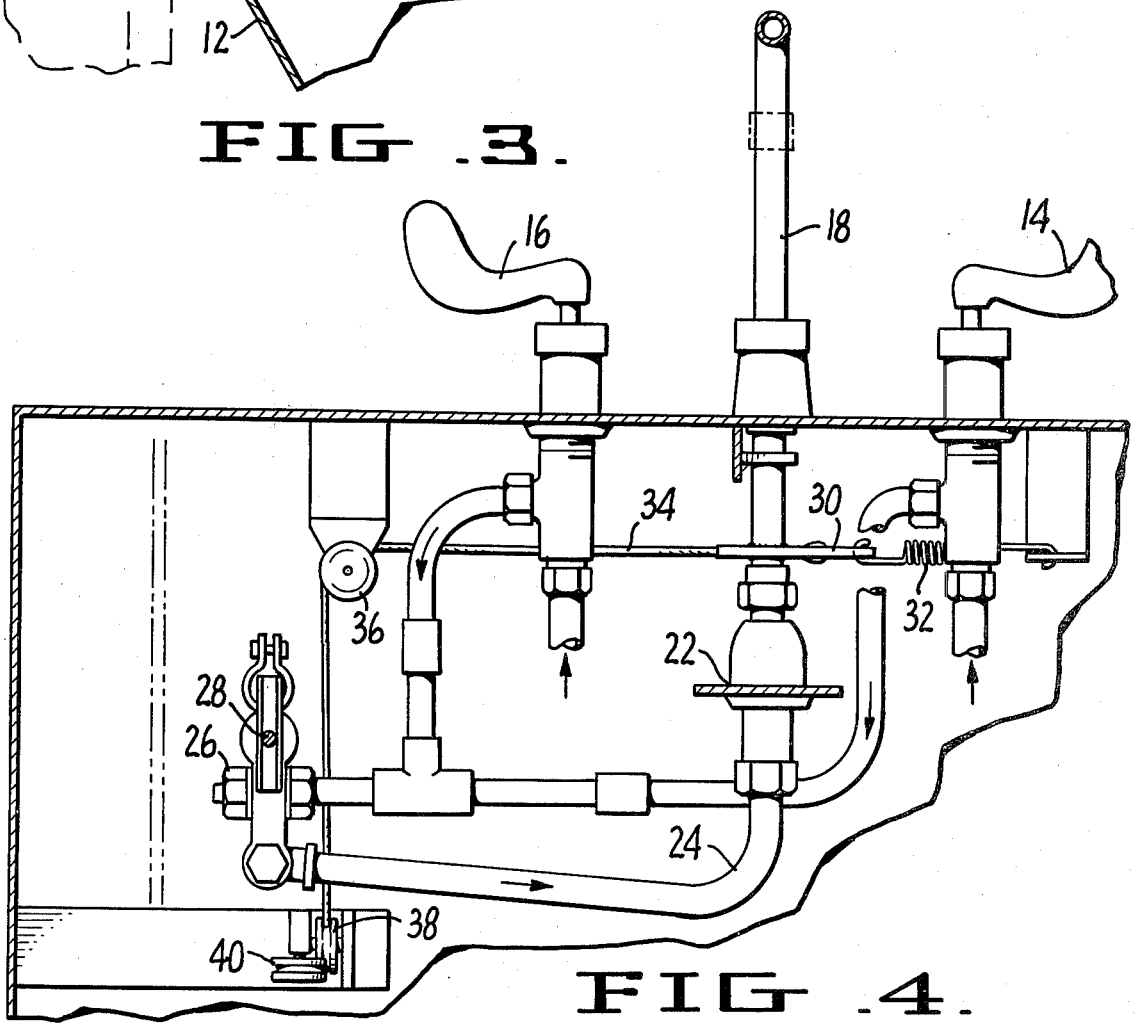
FIG. 4 is a section on the line 4—4 of FIG. 3.

In accordance with the present invention, the spout 18 is mounted on a swivel connection 22 mounted between the spout 18 and the inlet supply pipe 24 so that it can rotate. In the embodiment illustrated, the supply pipe 24 leads to a shut-off valve 26 having a push button actuator 28 so that water to the spout 18 is shut off when the lavatory is in the outer position, as is shown in FIG. 1, preventing the patient from getting splashed should one of the faucets be accidentally opened while the lavatory is in the out position. However, this valve 26 forms no part of the present invention, and the supply pipe 24 leading to the swivel 22 could extend directly to the water supply valves operated by handles 14 and 16. Spout 18 is provided with an arm 30 which is normally biased by spring 32, to the right (clockwise) as is shown in FIG. 3 so the terminal end 20 of the spout 18 is in the operative position, i.e. over the basin 10, as is shown in FIG. 2. A flexible cord 34 is attached to arm 30 and this passes over pulleys 36, 38, and 40 and is attached at point 42 of the frame 12.

The operation of the device will be obvious. When the washbasin is in use, as is shown in FIG. 2, the spring 32 will bias spout 18 in a clockwise direction so that one can use the lavatory in the normal manner. Now, if one wishes to use the toilet, the lavatory is swung out, putting tension on the cord 34, rotating lever arm 30 in a counterclockwise direction which will swing the spout so that the terminal end 20 is now over the frame 6 and does not extend over the toilet. In this position, the spout is completely out of the way so that there is no possibility of a patient injuring himself when rising from the toilet.

Although a specific mechanical system is shown for swinging the spout, it will be obvious to those skilled in the art that other mechanical motions, such as levers, could be used instead of the spring and cord arrangement illustrated.

I claim:

1. A combination toilet fixture including a wash bowl and a toilet comprising in combination:

a. a frame member having a toilet bowl mounted thereon;

b. a washbasin having a support hingedly mounted on said frame member whereby the washbasin can be swung horizontally to a first position directly over the toilet bowl and to a second position away from said toilet bowl;

c. a spout having a terminal end, said spout being rotatably mounted on said frame member, said spout being rotatable from a first position wherein said terminal end of the spout extends over the washbasin and to a second position wherein the terminal end of said spout extends over said frame member and d. a linkage between said washbasin support and said pivoted spout whereby said spout is moved from the first position when the washbasin is in the first position and to said second position when the washbasin is in said second position.

2. The combination fixture of claim 1 wherein said spout having a lever arm attached thereto with a spring biasing the spout in one direction and a flexible member connected to said washbasin support of said lever arm to move the lever arm against said spring.

* * * * *